US005980361A

United States Patent [19]

Müller et al.

[11] Patent Number: 5,980,361

[45] Date of Patent: Nov. 9, 1999

[54] METHOD AND DEVICE FOR POLISHING SEMICONDUCTOR WAFERS

[75] Inventors: Paul Müller, Ostermiething, Austria; Thomas Buschhardt, Burghausen, Germany; Heinrich Hennhöfer, Altötting, Germany; Norbert Sickmann, Burghausen, Germany; Rainer Neumann, Kirchdorf, Germany; Franz Mangs, Tittmoning, Germany; Manfred Thurner, Ach, Austria; Klaus Röttger, Schnaitsee, Germany

[73] Assignee: Wacker Siltronic Gesellschaft für Halbleitermaterialien AG, Burghausen, Germany

[21] Appl. No.: 08/987,515

[22] Filed: Dec. 9, 1997

[30] Foreign Application Priority Data

Dec. 12, 1996 [DE] Germany ..... 196 51 761

[51] Int. Cl.[6] ..... B24B 49/00; B24B 51/00; B24B 29/00; B24B 5/00

[52] U.S. Cl. ..... 451/9; 451/288; 451/289

[58] Field of Search ..... 451/364, 388, 451/397, 398, 385, 289, 287, 285, 5, 9, 8, 286, 288

[56] References Cited

U.S. PATENT DOCUMENTS

| | | | |
|---|---|---|---|
| 5,441,444 | 8/1995 | Nakajima | 451/289 |
| 5,479,414 | 12/1995 | Hirose et al. | 451/288 |
| 5,584,746 | 12/1996 | Tanaka et al. | 451/41 |
| 5,584,751 | 12/1996 | Kobayashi et al. | 451/288 |
| 5,605,488 | 2/1997 | Ohashi et al. | 451/7 |
| 5,624,299 | 4/1997 | Shendon | 451/28 |
| 5,645,474 | 7/1997 | Kubo et al. | 451/287 |

FOREIGN PATENT DOCUMENTS 0004033 9/1979 European Pat. Off. .

OTHER PUBLICATIONS

English Derwent Abstract Corresponding to EP 0 004033 A1 (79–H9837B[38]).

*Primary Examiner*—David A. Scherbel
*Assistant Examiner*—Philip J Hoffmann
*Attorney, Agent, or Firm*—Collard & Roe, P.C.

[57] ABSTRACT

A method is for the polishing of semiconductor wafers, which are mounted on a front side of a support plate and one side face of which is pressed against a polishing plate, which is covered with a polishing cloth, with a specific polishing pressure and polished. A device is provided which is suitable for carrying out the method. The method includes a) applying a specific pressure to at least one of a plurality of pressure chambers prior to the polishing of the semiconductor wafers, and b) during the polishing of the semiconductor wafers, transmitting the polishing pressure to a rear side of the support plate via elastic bearing surfaces of the pressure chambers to which pressure has been applied.

12 Claims, 2 Drawing Sheets

METHOD AND DEVICE FOR POLISHING SEMICONDUCTOR WAFERS

BACKGROUND OF THE INVENTION

1. Field of the Invention

The present invention relates to a method for polishing semiconductor wafers, which are mounted on a front side of a support plate and one side face of which wafer is pressed, by means of a polishing head, against a polishing plate, which is covered with a polishing cloth. A specific polishing pressure is applied and the wafer is polished. The present invention also relates to a device which is suitable for carrying out the method.

2. The Prior Art

Making a semiconductor wafer planar by means of a chemical/mechanical polishing method forms an important processing step in the process sequence to produce a flat, defect-free and smooth semiconductor wafer. In many production sequences, this polishing step constitutes the last shaping step. Hence, this step decisively determines the surface properties of the wafer, prior to the further use of the semiconductor wafer as starting material for the production of electrical, electronic and microelectronic components. An objective of the polishing method includes, in particular, the achieving of a very high degree of evenness and parallelism of the two wafer sides. Other objectives include the removing of surface layers which have been damaged by pretreatments ("damage removal") and reducing the microroughness of the semiconductor wafer.

Single side and double side polishing methods are usually employed. The present invention relates to the single side polishing of a batch of a plurality of semiconductor wafers ("single side batch polishing"). In this method, one side of each semiconductor wafer is mounted on the front side of a support plate. This mounting is by producing a positive and force-fitting connection between the wafer side and the support plate, for example by means of adhesion, bonding, cementing or the application of a vacuum. Generally, the semiconductor wafers are mounted on the support plate in such a way that they form a pattern of concentric rings. Following the mounting, the free wafer sides are pressed against a polishing plate, over which a polishing cloth is stretched. Then a supply of a polishing abrasive is provided at a specific polishing pressure and the free wafer sides are polished. In the process, the support plate and the polishing plate are usually rotated at different speeds. The polishing pressure required is transmitted to the rear side of the support plate by a pressure punch, which is referred to below as a polishing head. A multiplicity of the polishing machines used are designed such that they have a plurality of polishing heads at their disposal and accordingly are able to accommodate a plurality of support plates.

A number of factors make it difficult to achieve the desired evenness and parallelism of the semiconductor wafers, hereinafter called the desired wafer geometry. The wafer geometry is unsatisfactory particularly for polished semiconductor wafers whose sides are not parallel to one another but rather assume the shape of a wedge. For example, deviations from the desired wafer geometry are already caused by slight unevenness on the rear side of the support plate. This unevenness results in an increased or reduced polishing abrasion on the semiconductor wafer lying opposite the unevenness. Even a wedge shape of a semiconductor wafer caused by the polishing is ultimately the result of a polishing pressure acting inhomogeneously on the semiconductor wafer and of a material abrasion which as a result is necessarily uneven. Therefore, the polishing pressure frequently does not act uniformly on the semiconductor wafer. This is because the support plate is deformed radially during the polishing by its own weight or has a certain production-related, radial wedge shape. With polishing heads of identical design, it is possible for there to be differences in the transmission of the polishing pressure. This has the effect that the polishing head used also makes its presence felt in the polishing result. On some occasions, incipient wear of the polishing cloth is also a cause of the wafer geometry deteriorating during the course of a plurality of polishing passes.

To ameliorate the above-mentioned problems during attempts to achieve the desired wafer geometry, it is proposed in EP-4033 A1 to insert intermediate layers comprising soft, elastic bodies between the polishing head and the rear side of the support plate. This method cannot be automated and is susceptible to errors. This is because its success is largely dependent on the experience and watchfulness of the operating staff, who have to select and insert the intermediate layers on the basis of their width. However, even if no errors are made in doing this, the wedge shape of the polished semiconductor wafers remains above a specific limit value.

SUMMARY OF THE INVENTION

It is an object of the present invention to provide an improved uniformity of the polishing abrasion during the polishing of semiconductor wafers using a single side polishing machine so that in particular the wedge shape of the polished semiconductor wafers becomes negligible, or is eliminated.

The above object is achieved by the present invention which is directed to a method of polishing semiconductor wafers, which are mounted on a front side of a support plate and one side face of which is pressed, by means of a polishing head, against a polishing plate, which is covered with a polishing cloth, with a specific polishing pressure to cause wafer polishing, comprising the steps of a) applying a specific pressure to at least one of a plurality of pressure chambers prior to polishing of the semiconductor wafers, and b) during the polishing of the semiconductor wafers, transmitting the polishing pressure to a rear side of the support plate via elastic bearing surfaces of the pressure chambers to which pressure has been applied in step a).

The present invention is furthermore directed to a device for polishing semiconductor wafers which comprises:

a) a plurality of pressure chambers, to which pressure can be applied individually and which, on a side of the polishing head facing towards the rear side of the support plate, are arranged in concentric paths, and said pressure chambers having elastic bearing surfaces which, during the polishing of the semiconductor wafers, transmit the polishing pressure to the rear side of the support plate, as long as pressure has been applied to an associated pressure chamber, and b) a means for applying pressure to the pressure chambers.

The reason for the success of the invention is that it is possible to compensate for local pressure differences. These differences would result, for example, as a consequence of unevenness of the rear side of the support plate or as a result of an elastic deformation of the support plate. This compensation is by means of the pressure chambers being arranged between the polishing head and the support plate. The pressure force transmitted to the support plate by a pressure chamber to which pressure has been applied has the same value at every point of the elastic bearing surface which in the circumferential direction rests on the support plate. A particular advantage of the invention results from the fact that the pressure chambers to which pressure is applied are preferably selected automatically and pressure is applied to them automatically. Individual characteristics, which affect the polishing result, of the support plates used and polishing heads deployed can be taken into account in making this selection.

BRIEF DESCRIPTION OF THE DRAWINGS

Other objects and features of the present invention will become apparent from the following detailed description considered in connection with the accompanying drawing which discloses embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
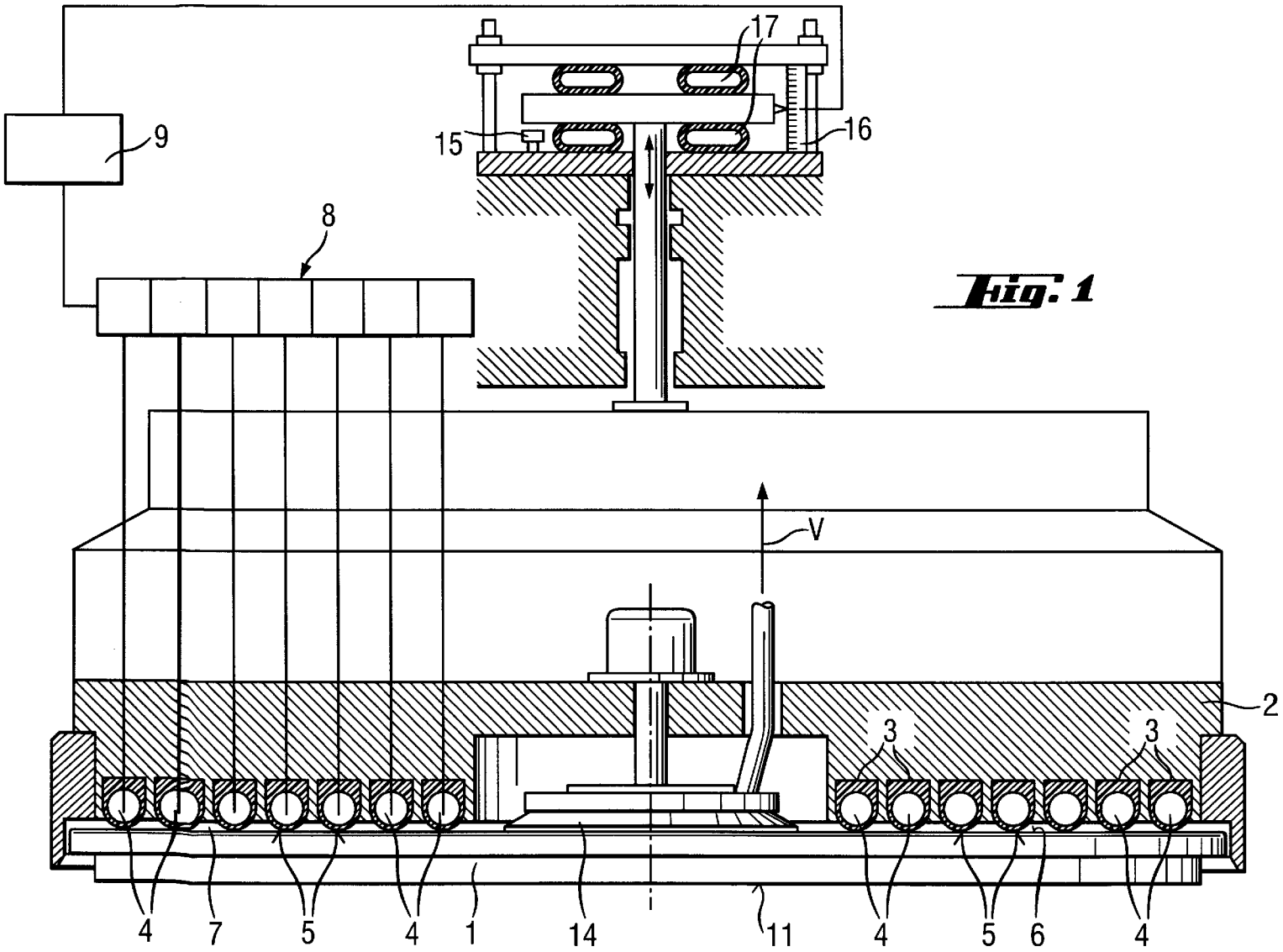
FIG. 1 shows a preferred embodiment of the device of the invention.

Turning now in detail to the drawings, FIG. 1 shows a preferred embodiment of a device for carrying out the method of the invention. That side of a polishing head 2 which faces towards a support plate 1 of a polishing machine has open channels 3. Channels 3 lie in concentric paths parallel to the circumference of the support plate. In each channel is situated a pressure chamber 4, for example a bellows or a flexible tube made of an elastic material with a low inherent rigidity. The device shown is equipped with a total of seven pressure chambers. If pressure is applied to a pressure chamber, by filling it with a gas or a liquid, a bearing surface 5, facing towards the support plate, of the pressure chamber presses against the rear side 6 of the support plate 1. The polishing head 2 is equipped with a vacuum tool 14, with the aid of which the support plate 1 can be vacuum held by the application of a vacuum V. The lines through the polishing head which are required for filling the pressure chambers with gas or liquid are not shown in FIG. 1. The application of pressure to a pressure chamber is also referred to below as "activating the pressure chamber" and the opposite operation is also referred to below as "deactivating a pressure chamber". The number of pressure chambers provided depends on the diameter of the support plate used and on the width of the bearing surface of a pressure chamber. Preferably 2 to 10, particularly preferably 2 to 7, pressure chambers are used, the bearing surfaces of which in the activated state of the pressure chambers are 10 to 220 mm, particularly preferably 10 to 30 mm, wide.

There is a gap 7 between the polishing head and the rear side of the support plate. The level of the pressure in the activated pressure chambers is preferably selected such that the polishing head can under no circumstances overcome the gap and damage the support plate during the polishing of the semiconductor wafers.

It is particularly preferred to prevent the polishing head from being lowered as far as the support plate by means of a mechanical barrier. In the preferred embodiment in accordance with FIG. 1, a stopper 15 is for this purpose integrated into the polishing head, the action of which means that the height of the gap 7 can never fall beneath a minimum value. As a result, mechanical damage to the support plate, which can impair the polishing result, is reliably avoided.

The device furthermore comprises a system of controllable valves 8, by means of which each pressure chamber can be activated and deactivated independently of the other pressure chambers. The system of valves 8 provides the possibility of achieving a pressure compensation between activated pressure chambers. It is particularly preferred in addition to provide a master computer 9, which controls the activation and deactivation of the pressure chambers completely automatically. After a polishing pass, this master computer is fed the determined values of the wafer geometry, for example the determined wedge-shape values. From these values, it calculates the number and position of the pressure chambers to be activated and causes the corresponding pressure chambers to be activated or deactivated automatically.

It is preferred in the calculation for the master computer also to take into account the effect of the respectively used support plate and the effect of the respectively used polishing head. Also the computer can take into account the effect resulting from production-related details, on the polishing result. The support plates and polishing heads being used can be identified, for example, by means of a bar code recognition. The master computer then accesses a data base in which offsets are stored which specify which chambers are to be activated or deactivated when using a specific support plate or a specific polishing head or a specific combination of support plate and polishing head. The offsets are updated at regular intervals following the automatic evaluation of the polishing result of a plurality of preceding polishing passes.

It has furthermore proven advantageous to adjust the height of the gap 7 during polishing to a desired distance which lies within a narrow tolerance range. This measure reduces the scatter of the wedge-shaped values. The adjustment is carried out automatically by means of the master computer 9, which is connected to a measuring device 16. The master computer continually records the actual height of the gap 7 and compares this height with the selected desired distance. If the actual height lies outside predetermined lower and upper limit values, the master computer is used to change the pressure in the pressure chambers 4. This causes the polishing head to be raised or lowered until the actual height of the gap 7 lies within the desired tolerance range. Preferred values for the upper and lower limits of the tolerance range are 4.2 mm and 3.8 mm, respectively. The polishing pressure is preferably set with the aid of pressure pads 17.

Figure 2A:
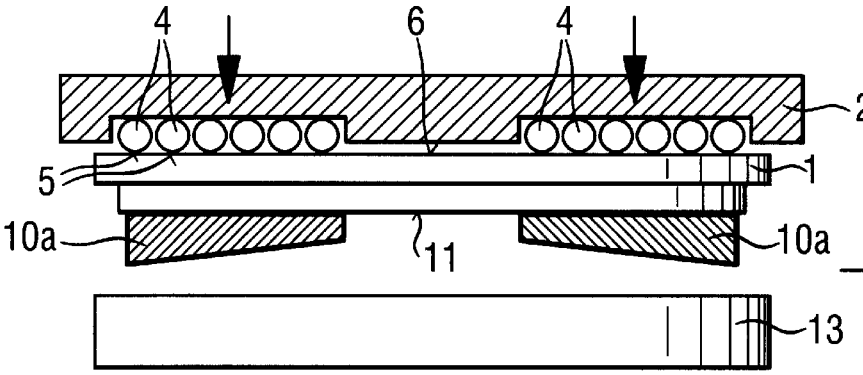
FIGS. 2*a* and 2*b* show an embodiment for eliminating a wedge shape which is thinner at the center when polishing semiconductor wafers in accordance with the method of the invention.
Figure 2B:
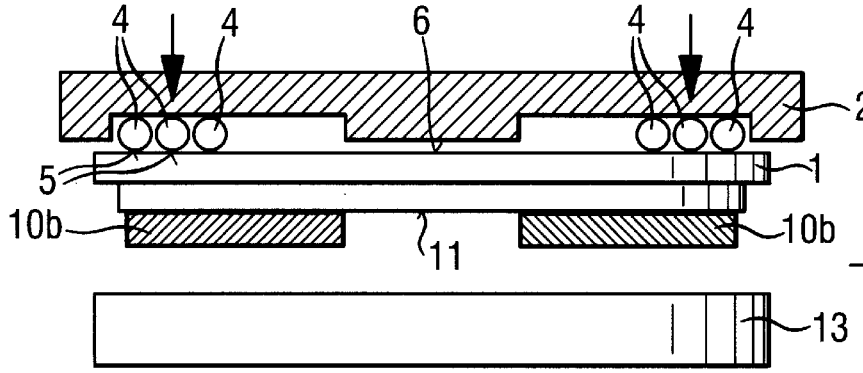
Figure 3A:
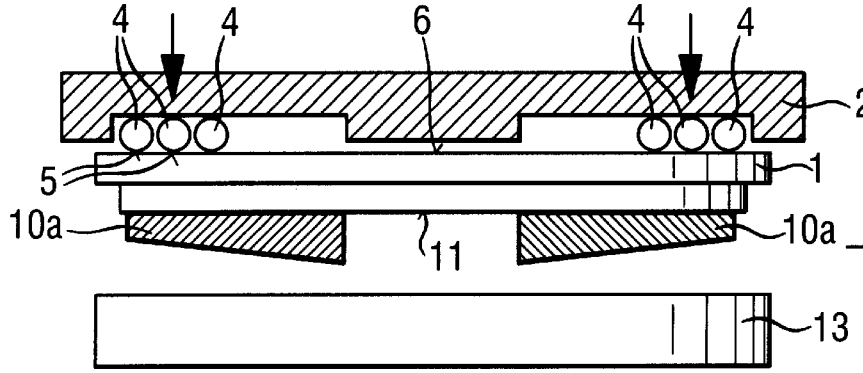
FIGS. 3*a* and 3*b* show another embodiment for eliminating a wedge shape which is thinner at the outer edge when polishing wafers according to the invention.

FIGS. 2*a* and 2*b*, and FIGS. 3*a* and 3*b* diagrammatically show how the method of the invention is able in particular to improve the polishing result with regard to the wedge shape of polished semi-conductor wafers. FIGS. 2*a* and 3*a* show the situation in which polished semiconductor wafers 10*a* are wedge-shaped and are mounted on the front side 11 of a support plate 1. These wafers have been pressed against a polishing plate 13, covered with a polishing cloth, and have been polished with a specific polishing pressure. In FIG. 2*a*, the thickness of the semiconductor wafers decreases in the direction towards the center of the support plate, for which reason a positive wedge shape is referred to. In FIG. 3*a*, the situation is the reverse. The semiconductor wafers 10*a* of FIG. 3*a* have a negative wedge shape, and decrease in thickness toward the edge of the support plate. In both cases, the wedge shape of the semiconductor wafers occurred because, for example, a support plate was deformed into a wedge shape in the radial direction. Another reason for the wedge shape is because a polishing cloth which was worn to different extents in the radial direction had been used (not shown). The focal point of the transmission of the polishing pressure, which is indicated by arrows, was not at a location which was adapted to this situation.

As is shown in FIG. 2*a*, all six available pressure chambers 4 had been activated and subjected to the same pressure by means of pressure compensation between the chambers. The focal point of transmission of the polishing pressure was situated approximately above the center of the semiconductor wafers. In accordance with the embodiment shown in FIG. 3*a* during the polishing which had led to semiconductor wafers with a negative wedge shape, the three outer pressure chambers were activated. This will cause the focal point of the transmission of the polishing pressure to be situated above the edge region of the semiconductor wafers.

Figure 3B:
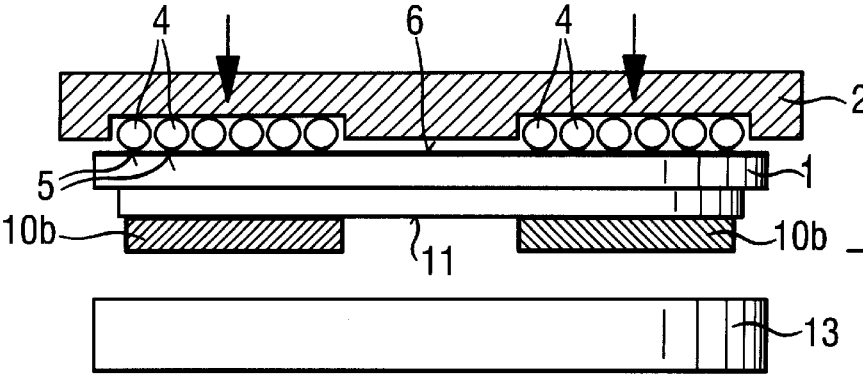

In order to achieve the situation where the sides of semiconductor wafers in a following polishing pass have a higher degree of evenness and parallelism, the focal point of the transmission of the polishing pressure is displaced with the aid of the pressure chambers 4. This is illustrated in the respective structure shown in FIG. 2*b* and FIG. 3*b*. Another positive wedge shape of subsequently polished semiconductor wafers 10*b* is counteracted by switching off inner, in the example shown three, pressure chambers prior to the polishing of these semiconductor wafers. Consequently, the focal point of the pressure transmission is displaced radially outwards, so that it is situated above the edge region of the semiconductor wafers 10*b* (as shown in FIG. 2*b*). Another negative wedge shape of subsequently polished semiconductor wafers 10*b* is counteracted by activating in FIG. 3*b* the inner, in the example shown three, pressure chambers prior to the polishing of these semiconductor wafers. Consequently, the focal point of the pressure transmission is displaced radially inwards, so that it is situated above the center of the semiconductor wafers 10*b* (as shown in FIG. 3*b*).

It is clear from the preceding description that the method can be configured in a wide variety of ways. The only prerequisite is that at least one of the pressure chambers be activated during the polishing of semiconductor wafers and transmits the polishing pressure to the rear side of the support plate. It is preferred, but not absolutely necessary, to provide pressure compensation between activated pressure chambers. The sequence of activated pressure chambers illustrated in FIGS. 2*a* and 2*b* or in FIGS. 3*a* and 3*b* is likewise only an example. It may also, if appropriate, be necessary, in order to achieve the desired wafer geometry, to select a sequence in which an activated pressure chamber becomes adjacent only to one or more deactivated pressure chambers. It may also be necessary to deactivate one or more of the outer pressure chambers during the polishing.

Other objects and features of the present invention will become apparent from the following Examples, which disclose the embodiments of the present invention. It should be understood, however, that the Examples are designed for the purpose of illustration only and not as a definition of the limits of the invention.

EXAMPLES

Several hundreds of polishing passes were carried out using a commercially available single side polishing machine with four polishing heads. After each polishing pass, the wedge shape of the polished semiconductor wafers was determined along a preferred direction. Table 1 below shows the averages of the deviations found for the wedge shape, and Tables 2 and 3 show the averages of the wedge shape of the semiconductor wafers mounted on the front side of the support plate in the form of concentric rings.

It was attempted, in a series of polishing passes (comparative series), to improve the polishing result by inserting intermediate layers, as described in EP-4033 A1. In all other polishing passes, the invention was employed (test series A, test series B+, B−, C+, C−). The effect of the offsets which take into account the individual characteristics of the support plates used (test series B+ and B−) and of the polishing heads deployed (test series C+ and C−) on the polishing result was also tested ("+" means polishing passes with offsets, "−" means polishing passes without offsets). The tables each show the average deviations (positive or negative wedge shape) from a target value set at zero.

TABLE 1

| | Polishing head 1 | Polishing head 2 |
|---|---|---|
| Comparative series | 0.7 | 0.6 |
| Test series A | 0.3 | 0.4 |

TABLE 2

| | Polishing head 1 | Polishing head 2 | Polishing head 3 | Polishing head 4 |
|---|---|---|---|---|
| Test series B− | −0.2 | −1 | 0.5 | 0.2 |
| Test series B+ | −0.1 | 0.2 | −0.1 | 0.2 |

TABLE 3

| | Polishing head 1 | Polishing head 2 | Polishing head 3 | Polishing head 4 |
|---|---|---|---|---|
| Test series C− | −0.5 | −0.1 | 0.1 | 0 |
| Test series C+ | 0.1 | −0.1 | 0.1 | 0 |

While several embodiments of the present invention have been shown and described, it is to be understood that many changes and modifications may be made thereunto without departing from the spirit and scope of the invention as defined in the appended claims.

What is claimed is:

1. Method of polishing semiconductor wafers, which are mounted on a front side of a support plate and one side face of each of said wafers is pressed against a polishing plate, which is covered with a polishing cloth, with a specific polishing pressure to cause wafer polishing, comprising the steps of:

a) applying a varying pressure to at least one of a plurality of pressure chambers prior to the polishing of the semiconductor wafers; and said support plate having a circumference; said pressure chambers lying in concentric paths parallel to the circumference of the support plate; and b) said pressure chambers having elastic bearing surfaces which, during the polishing of the semiconductor wafers, transmit the polishing pressure to a rear side of the support plate, and during the polishing of the semiconductor wafers, transmitting the polishing pressure to the rear side of the support plate via said elastic bearing surfaces of the pressure chambers to which pressure has been applied in step a).

2. Method according to claim 1, further comprising carrying out a pressure compensation between the pressure chambers to which pressure has been applied in the event of pressure having been applied to a plurality of the pressure chambers.

3. Method according to claim 1, comprising selecting the pressure chambers to which pressure is applied automatically, with the aid of a computer, prior to a polishing pass.

4. Method according to claim 3, comprising when selecting the pressure chambers, taking offsets into account which predetermine a preselection of pressure chambers for the support plate used and the polishing head deployed.

5. Method according to claim 1, comprising adjusting a height of a gap between the polishing head and the rear side of the support plate automatically during the polishing, in order to keep the gap within a predetermined tolerance range.

6. Method according to claim 5, comprising using a mechanical barrier for preventing the height of the gap from being able to fall below a minimum value.

7. Device for polishing semiconductor wafers, comprising a support plate having a rear side and a front side, and a polishing head, which during the polishing presses semiconductor wafers, which are fixed on the front side of the support plate, against a polishing plate, which is covered with a polishing cloth, with a specific polishing pressure, and further comprising:

a) a plurality of pressure chambers, to which pressure can be applied individually and which, on a side of the polishing head facing towards the rear side of the support plate, are arranged in concentric paths, and said pressure chambers having elastic bearing surfaces which, during the polishing of the semiconductor wafers, transmit the polishing pressure to the rear side of the support plate, as long as pressure has been applied to an associated pressure chamber, and said support plate having a circumference; and said pressure chambers lying in said concentric paths parallel to the circumference of the support plate; and b) means for applying pressure to the pressure chambers.

8. Device according to claim 7, comprising means for carrying out a pressure compensation between the pressure chambers to which pressure has been applied.

9. Device according to claim 7, wherein there are 2 to 10 pressure chambers, each of which has bearing surfaces which range between 10 to 220 mm in width.

10. Device according to claim 7, further comprising a master computer, which, prior to a polishing pass, selects the pressure chambers to which pressure is to be applied and automatically applies pressure to these chambers.

11. Device according to claim 7, further comprising a mechanical barrier, the action of which means that a gap between the polishing head and the rear side of the support plate cannot fall below a minimum height.

12. Device according to claim 7, comprising a computer-assisted control system for adjusting a height of a gap between the polishing head and the rear side of the support plate.

* * * * *